US009099072B2

(12) United States Patent
Yoshino

(10) Patent No.: US 9,099,072 B2
(45) Date of Patent: Aug. 4, 2015

(54) CYMBAL SILENCER

(71) Applicant: ROLAND CORPORATION, Shizuoka (JP)

(72) Inventor: Kiyoshi Yoshino, Shizuoka (JP)

(73) Assignee: ROLAND CORPORATION, Shizuoka (JP)

( * ) Notice: Subject to any disclaimer, the term of this patent is extended or adjusted under 35 U.S.C. 154(b) by 102 days.

(21) Appl. No.: 13/902,860

(22) Filed: May 27, 2013

(65) Prior Publication Data

US 2014/0083276 A1 Mar. 27, 2014

(30) Foreign Application Priority Data

Sep. 25, 2012 (JP) ..... 2012-211483

(51) Int. Cl.
*G10D 13/02* (2006.01)
*G10K 11/00* (2006.01)
*G10D 13/06* (2006.01)

(52) U.S. Cl.
CPC ..... *G10K 11/002* (2013.01); *G10D 13/06* (2013.01)

(58) Field of Classification Search
CPC ..... G10K 11/002; G10D 13/06
USPC ..... 84/411 M
See application file for complete search history.

(56) References Cited

U.S. PATENT DOCUMENTS

| | | | | |
|---|---|---|---|---|
| 4,911,056 | A | 3/1990 | Belli et al. | |
| 6,310,277 | B1 | 10/2001 | Shelley | |
| 6,720,491 | B1 * | 4/2004 | Kroncke | 84/422.3 |
| 7,763,788 | B2 * | 7/2010 | Wachter | 84/411 M |
| 8,841,527 | B2 | 9/2014 | Shih et al. | |
| 2014/0069265 | A1 * | 3/2014 | Shih et al. | 84/730 |
| 2014/0216234 | A1 | 8/2014 | Wei | |

FOREIGN PATENT DOCUMENTS

| | | |
|---|---|---|
| EP | 1742198 | 1/2007 |
| JP | 08-272359 | 10/1996 |

* cited by examiner

*Primary Examiner* — Jianchun Qin
(74) *Attorney, Agent, or Firm* — Jianq Chyun IP Office

(57) ABSTRACT

A cymbal silencer reduces a percussive sound of a cymbal by abutting the cymbal silencer against the cymbal. The cymbal silencer includes a frame having an inner part, a connecting part and an outer part, and a first elastic member. The inner part has an insertion hole into which a bar-shaped rod for fixing the cymbal is inserted. One side of the connecting part is connected to the inner part and extends toward a direction away from the insertion hole. The outer part is connected to the other side of the connecting part and is disposed at a position further away from the insertion hole than the one side of the connecting part. The outer part corresponds to the bow portion of the cymbal. The first elastic member is installed on one surface side of the outer part of the frame and is composed of the first elastic material.

16 Claims, 3 Drawing Sheets

CYMBAL SILENCER

CROSS-REFERENCE TO RELATED APPLICATIONS

This application claims the priority benefit of Japan application serial no. 2012-211483, filed on Sep. 25, 2012. The entirety of the above-mentioned patent application is hereby incorporated by reference herein and made a part of this specification.

BACKGROUND OF THE INVENTION

1. Field of the Invention

The present invention relates to a cymbal silencer. Particularly, the present invention can significantly reduce a percussive sound generated from a bow portion of the cymbal. Moreover, the present invention can prevent a decline of the percussing sense of the cymbal.

2. Description of the Related Art

A cymbal silencer is known to reduce a percussive sound of a cymbal by abutting the cymbal silencer against a metal acoustic cymbal (hereinafter, "cymbal") during performance.

For example, Japan Patent Publication No. H08-272359 Gazette disclosed a technology of attaching a cymbal silencer composed of a stretchable material, such as a rubber, to an upper surface side or an edge of the cymbal. During a performance, a percussive sound of the cymbal can be reduced by striking a part of the cymbal attached with the cymbal silencer.

In addition, Europe Patent Publication No. 1742198 Gazette disclosed a technology of abutting a damping ring (cymbal silencer) against a lower surface side of a cymbal and fixing the damping ring to a rod together with the cymbal. Under this condition, a percussive sound of the cymbal can be reduced during a performance.

However, in the above-mentioned Patent Document 1, the percussive sound is reduced by striking the part attached with the cymbal silencer. Therefore, a percussing sense obtained by directly hitting a metal cymbal may be lost.

In addition, in the above-mentioned Patent Document 2, the damping ring only abuts against a center part of the cymbal (a bell portion). Therefore, a vibration of a peripheral edge part of the cymbal (a bow portion) that vibrates more significantly than the center part of the cymbal fixed to the rod can't be effectively decreased. Accordingly, the percussive sound of the cymbal produced from the peripheral edge part of the cymbal can't be significantly reduced.

PRIOR ART REFERENCE

Patent Document

Patent Document 1: Japan Patent Publication No. H08-272359 Gazette ([0005] and [0006], etc.)

Patent Document 2: Europe Patent Publication No. 1742198 Gazette (FIG. 2, etc.)

SUMMARY OF THE INVENTION

According to one aspect of the present invention, a cymbal silencer has the following effect. A first elastic member comprising a first elastic material is installed on one surface side of a frame. The frame and the cymbal are secured while the one surface side of the frame faces a lower surface of the cymbal, and the frame and the cymbal together are inserted with the rod. Hereby, the first elastic member is pressed against the cymbal.

An outer part of the frame is disposed at a position corresponding to a bow portion of the cymbal. Therefore, the first elastic member installed on one surface side of the outer part can be pressed against the bow portion. Hereby, a vibration of the bow portion, which normally will become larger, can be effectively reduced. Accordingly, a percussive sound produced and generated from the bow portion can be significantly reduced.

In addition, the first elastic member is pressed against the lower surface side of the cymbal so that a performer can directly strike an upper surface side of the cymbal when performing. Therefore, the decline of the percussing sense/striking feeling of the cymbal can be prevented while the percussive sound of the cymbal is reduced.

According to other aspect of the present invention, the cymbal silencer has the following additional effect. A second elastic member comprising a second elastic material is installed on one surface side of an inner part of the frame. The frame and the cymbal are secured while the one surface side of the frame faces the lower surface of the cymbal, and the frame and the cymbal together are inserted with the rod. Hereby, the second elastic member is pressed against a bell portion of the cymbal so that a vibration generated from the bell portion can be effectively reduced. Therefore, a percussive sound generated from the bell portion can be significantly reduced.

According to a further aspect of the present invention, the cymbal silencer has the following additional effect. A third elastic member comprising a third elastic material is installed on the one surface side of the frame at a position closer to the insertion hole than the first elastic member but further away from the insertion hole than the second elastic member. The frame and the cymbal are secured while the one surface side of the frame faces the lower surface of the cymbal, and the frame and the cymbal together are inserted with the rod. Hereby, the third elastic member is pressed against the bow portion of the cymbal so that a vibration generated from an inner side of the bow portion or from the bell portion can be effectively decreased. As a result, a percussive sound of the cymbal can be significantly reduced.

According to a further aspect of the present invention, the cymbal silencer has the following additional effect. An inner part of the frame is fixed in a manner that the inner part is swingable with respect to the rod so that the frame swings together with the cymbal. Hereby, blocking the swinging of the cymbal due to the frame can be suppressed so that the percussing sense of the cymbal is not impaired.

According to a further aspect of the present invention, the cymbal silencer has the following additional effect. The frame comprises a fourth elastic material and the inner part and the outer part of the frame are partially connected by a connecting part, and the outer part is configured to be movable in a vertical direction relative to the inner part. Hereby, the first elastic member can be tightly attached to the bow portion of the cymbal. Therefore, the vibration of the bow portion can be effectively decreased.

According to a further aspect of the present invention, the cymbal silencer has the following additional effect. The connecting part of the frame is configured by radially disposing a plurality of members configured in a flat plate shape so that a bending rigidity of the connecting part in the vertical direction can be less. Hereby, it is easier for the connecting part to be elastically deformed in the vertical direction, and the outer part becomes easier to move in the vertical direction relative to the inner part. As a result, the first elastic member can be tightly attached to the bow portion of the cymbal; therefore, the vibration of the bow portion can be effectively decreased.

According to a further aspect of the present invention, the cymbal silencer has the following additional effect. A sensor is installed on the frame and detects the vibration of the frame, so that the cymbal can be used as an electronic cymbal.

DESCRIPTION OF EMBODIMENTS

Figure 1:
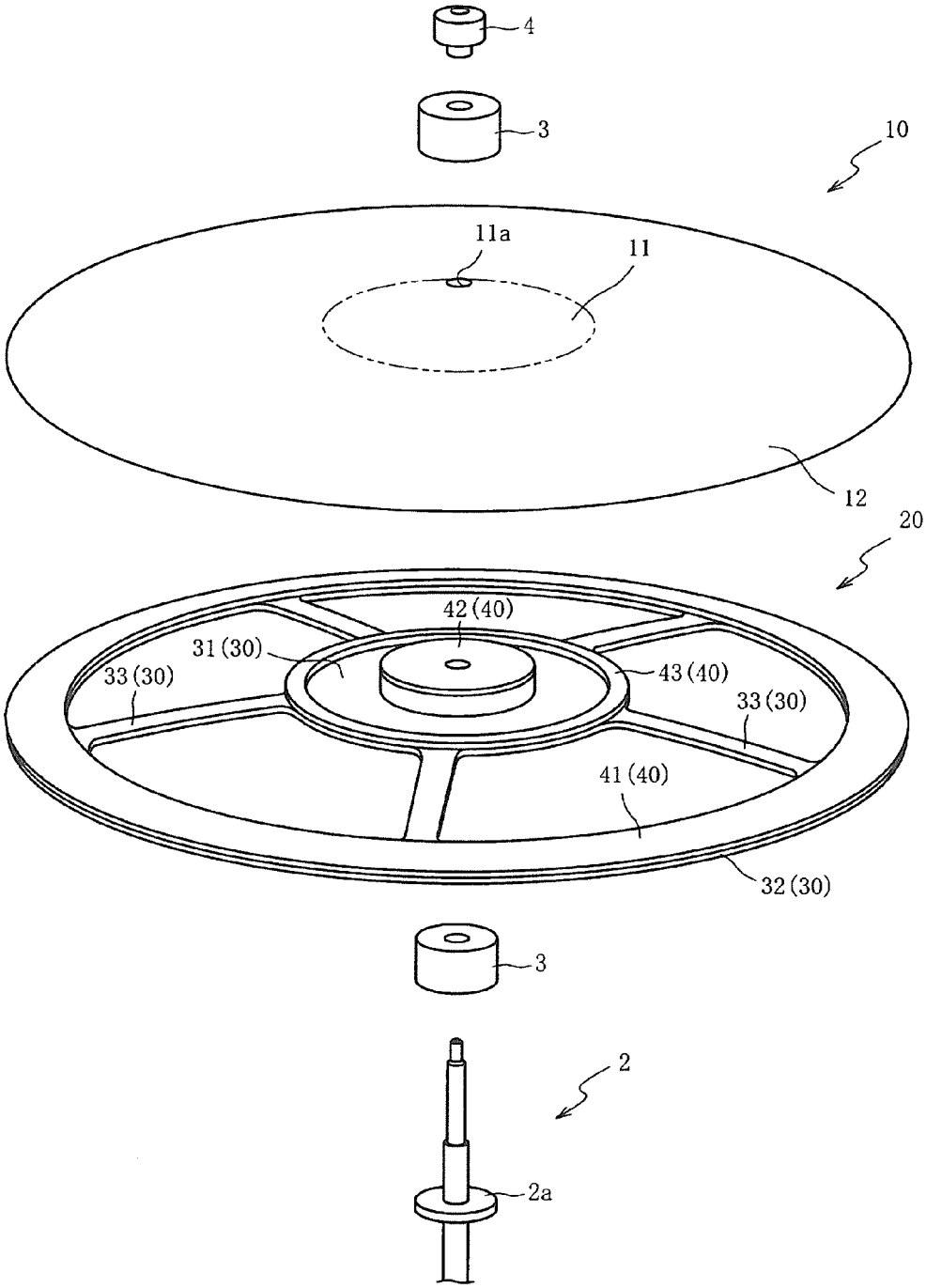
FIG. 1 is an exploded perspective view of a cymbal stand in which a cymbal silencer according to one embodiment of the present invention and a cymbal are fixed.

Preferred embodiments of the present invention are described below referring to the accompanying drawings. First, referring to FIG. 1, a configuration of a cymbal stand is described in which a cymbal silencer 20 and a cymbal 10 are fixed. In FIG. 1, only a main section of the cymbal stand is shown and the other part is omitted.

The cymbal stand is a stand for disposing the cymbal 10 at a position that facilitates the performance of a performer. As shown in FIG. 1, the cymbal stand includes a bar-shaped rod 2, a pair of felt washers 3 and a clamp nut 4. The rod 2 is insertable into a pair of the felt washers 3. The clamp nut 4 is disposed above a pair of the felt washers 3 (an upper side in FIG. 1).

The rod 2 is a metal part in which the cymbal 10 is fixed. A metal washer 2*a* with a flange shape is formed at the position away from an upper end of the rod 2 in a predetermined distance. An external thread is threaded at a position above and away from the metal washer 2*a* in a predetermined distance.

The felt washers 3 are cylindrical members composed of felts. An internal diameter of the felt washers 3 is larger than an external diameter of the rod 2. Moreover, an external diameter of the felt washers 3 is substantially equal to an external diameter of the metal washer 2*a* of the rod 2. The clamp nut 4 has an internal thread which can be screwed to the external thread threaded into the rod 2.

The cymbal 10 is a metal acoustic cymbal to be hit by a performer. The cymbal 10 includes a bell portion 11 and a bow portion 12. The bell portion 11 is formed in a center part of the cymbal 10. The bow portion 12 is extended in a flange shape from an outer edge of the bell portion 11. In the embodiment of the present invention, the bow portion 12 represents the entire part excluding the bell portion 11 from the cymbal 10 (a part combining the bow and the edge of the cymbal).

The bell portion 11 is a cup-shaped part sloping downward toward the peripheral of the bell portion 11 in a radial direction. A cymbal insertion hole 11*a*, in which the rod 2 is insertable there-into, is drilled into a center part of the bell portion 11. The bow 12 is a ring-shaped part sloping downward toward the peripheral of the bow 12 in a radial direction. The slope in the radial direction of bow portion 12 is formed in a less steep than that of the bell portion 11.

The cymbal silencer 20 is a tool for reducing a percussive sound produced when the cymbal 10 is struck. The cymbal silencer 20 is configured to be insertable by the rod 2.

Figure 2A:
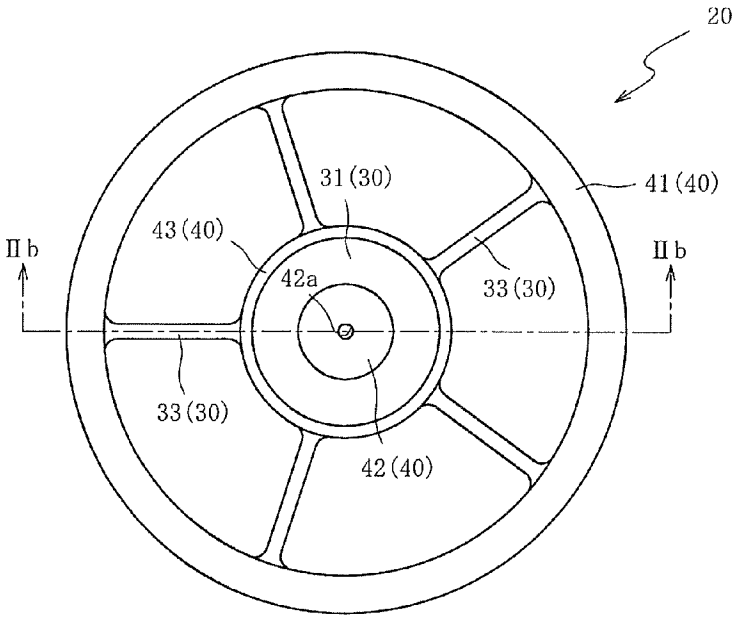
FIG. 2A is a top view of the cymbal silencer.
Figure 2B:
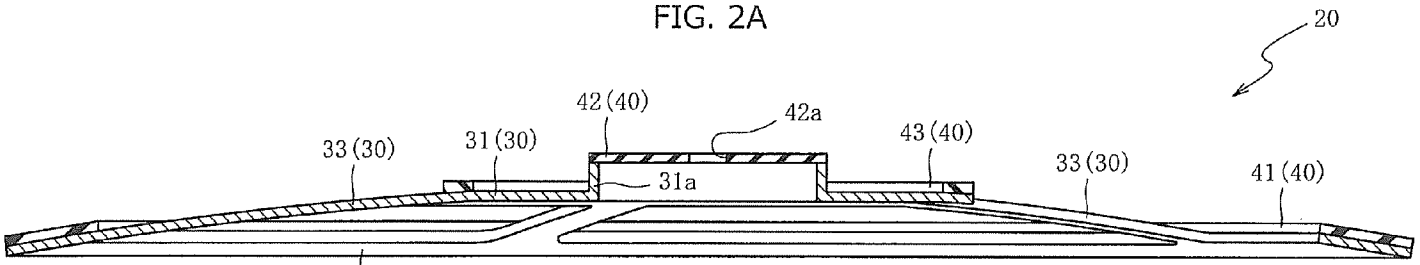
FIG. 2B is an enlarged sectional view of the cymbal silencer on the line IIb-IIb in FIG. 2A.

Next, referring to FIG. 2, a configuration of the cymbal silencer 20 is described.

The cymbal silencer 20 includes a frame 30 and a plurality of elastic members 40. The frame 30 comprises an elastic material. The plurality of the elastic members 40 comprise an elastic material with higher elasticity than that of the frame 30.

The frame 30 is a member for supporting the plurality of the elastic members 40. The frame 30 comprises a resin material with a predetermined elasticity. The frame 30 includes an inner part 31, an outer part 32 and a connecting part 33. The inner part 31 is configured at the center part of the frame 30. The outer part 32 is disposed at a peripheral side of the inner part 31. Regarding the connecting part 33, one side thereof is connected to the inner part 31 and the other side thereof is connected to the outer part 32.

The inner part 31 is formed in a substantially ring-shape when viewed from the top. An external diameter of the inner part 31 is larger than an internal diameter (a connecting part of the bell portion 11 and the bow portion 12 of the cymbal 10) of the bow portion 12 (see FIG. 3) of the cymbal 10. In addition, a cylinder-shaped frame insertion tube part 31*a* is formed at the center part of the inner part 31. The frame insertion tube part 31*a* is protruded from one surface side of the frame 30 (an upper side in FIG. 2B).

The frame insertion tube part 31*a* is a part through which the rod 2 (see FIG. 3) is inserted. An internal diameter of the frame insertion tube part 31*a* is larger than the external diameters of the felt washers 3 and the metal washer 2*a* (see FIG. 3). Moreover, an external diameter of the frame insertion tube part 31*a* is smaller than the internal diameter of the bow 12 (see FIG. 3) of the cymbal 10.

The size of the frame insertion tube part 31*a* in an axial direction is set in order for the upper end of the frame insertion tube part 31*a* not to contact with the bell portion 11 of the cymbal 10 when the cymbal 10 is stacked on an upper surface side of the cymbal silencer 20.

The outer part 32 is formed in a substantially ring shape when viewed from the top. In addition, the outer part 32 slopes downward toward the peripheral of the outer part 32 in the radial direction. An internal diameter of the outer part 32 is larger than the internal diameter of the bow portion 12 of the cymbal 10. An external diameter of the outer part 32 is substantially equal to the external diameter of the bow portion 12. That is, when viewed from an axial direction of the outer part 32, the outer part 32 is disposed at a position farther away from the frame insertion tube part 31*a* in the radial direction than the connecting part 33, and corresponds to the bow portion 12 of the cymbal 10.

The connecting part 33 is configured by radially disposing a plurality of members formed in a flat plate shape. A cross section of each of the plurality members, which is vertical to the radial direction of the outer part 32, is foamed in a substantially rectangular shape using a tangential direction of the outer part 32 as a longitudinal direction of the rectangular shape. Therefore, the bending rigidity of the connecting part 33 in the axial direction of the outer part 32 can be reduced. A thickness of each member of the connecting part 33 (a linear dimension in the axis direction) is set to be a size such that one end side (a side connected to the outer part 32) of each member of the connecting part 33 can cause an elastic deformation in the axial direction of the outer part 32 with respect to the other end side (a side connected to the inner part 31).

"A vertical direction" in claim 5 corresponds to the axial direction of the outer part 32.

In addition, the connecting part 33 slopes downward from the inner part 31 toward the peripheral of the connecting part 33 in the radial direction. Moreover, the slope in the radial direction of the connecting part 33 is less steep than that of the bow portion 12 of the cymbal 10.

The outer part 32 and the connecting part 33 may be integrally formed. On the other hand, the inner part 31, the outer part 32 and the connecting part 33 may be individually formed and then joined together as the frame 30.

The plurality of the elastic members 40 includes members for reducing a vibration of the cymbal 10 by abutting to the cymbal. The plurality of the elastic members 40 comprise a first elastic member 41, a second elastic member 42 and a third elastic member 43. The first elastic member 41 is installed on one surface side of the outer part 32 of the frame 30. The second elastic member 42 is installed on the frame insertion tube part 31*a* of the inner part 31. The third elastic member 43 is disposed apart from the first elastic member 41 towards the interior of the frame 30 in the radial direction, and is disposed apart from the second elastic member 42 towards the exterior of the frame 30 in the radial direction and is installed at a peripheral edge part of one surface side of the inner part 31.

The first elastic member 41 is a spongy member formed in a ring shape which is successive along a circumference of the outer part 32. An internal diameter of the first elastic member 41 is larger than the internal diameter of the bow portion 12 (see FIG. 3) of the cymbal 10. An external diameter of the first elastic member 41 is substantially equal to the external diameter of the bow portion 12. In addition, the internal diameter and the external diameter of the first elastic member 41 are substantially equal to the internal diameter and the external diameter of the outer portion 32 of the frame 30.

The first elastic member 41 is formed in a ring shape successively along the circumference of the outer part 32 so that the first elastic member 41 can be configured as a single member. Therefore, comparing with a case in which the first elastic member 41 comprises a plurality of members, an operation for installing the first elastic member 41 on the outer part 32 by adhesion, etc., can be simplified.

In addition, the first elastic member 41 installed on the outer part 32 by adhesion, etc., becomes easy to come off from the peripheral edge part of the first elastic member 41. On the contrary, the first elastic member 41 is made of a single member formed in a ring shape and continuously along the circumference of the outer part 32. Therefore, comparing with a case in which the first elastic member 41 comprises a plurality of members in which the first elastic member 41 is divided, the first elastic member 41 made of a single member can be prevented from coming off from the outer part 32.

A surface of the first elastic member 41 opposite to a surface of the first elastic member 41 to be attached on of the outer part 32 is abutted to the bow portion 12 of the cymbal 10. The surface abutted to the bow portion 12 is a smooth surface. Hereby, comparing with a case in which the surface abutted to the bow portion 12 is uneven, an abutting area of the first elastic member 41 and the bow portion 12 can be ensured. As a result, a vibration of the bow portion 12 can be effectively decreased; therefore, a percussive sound of the cymbal 10 can be significantly reduced.

The second elastic member 42 is a rubbery member formed in a disk shape. An external diameter of the second elastic member 42 is substantially equal to the external diameter of the frame insertion tube part 31*a* of the inner part 31. A peripheral edge part of the second elastic member 42 is installed on the upper end surface of the frame insertion tube part 31*a* (an upper surface in FIG. 2B). In addition, an elastic member insertion hole 42*a* is drilled into a center part of the second elastic member 42. The rod 2 (see FIG. 3) is inserted into the elastic member insertion hole 42*a*.

The third elastic member 43 is a spongy member formed in a ring shape which is configured continuously along a circumference of the inner part 31. An internal diameter of the third elastic member 43 is larger than the external diameter of the second elastic member 42. Moreover, an external diameter of the third elastic member 43 is substantially equal to the external diameter of the inner part 31. The third elastic member 43 is configured to be equal to the first elastic member 41, except for the internal diameter and the external diameter. That is, the third elastic member 43 is installed on a side closer to the frame insertion tube part 31*a* of the frame than the first elastic member 41, and installed at a position further away from the frame insertion tube part 31*a* than the second elastic member 42.

Figure 3:
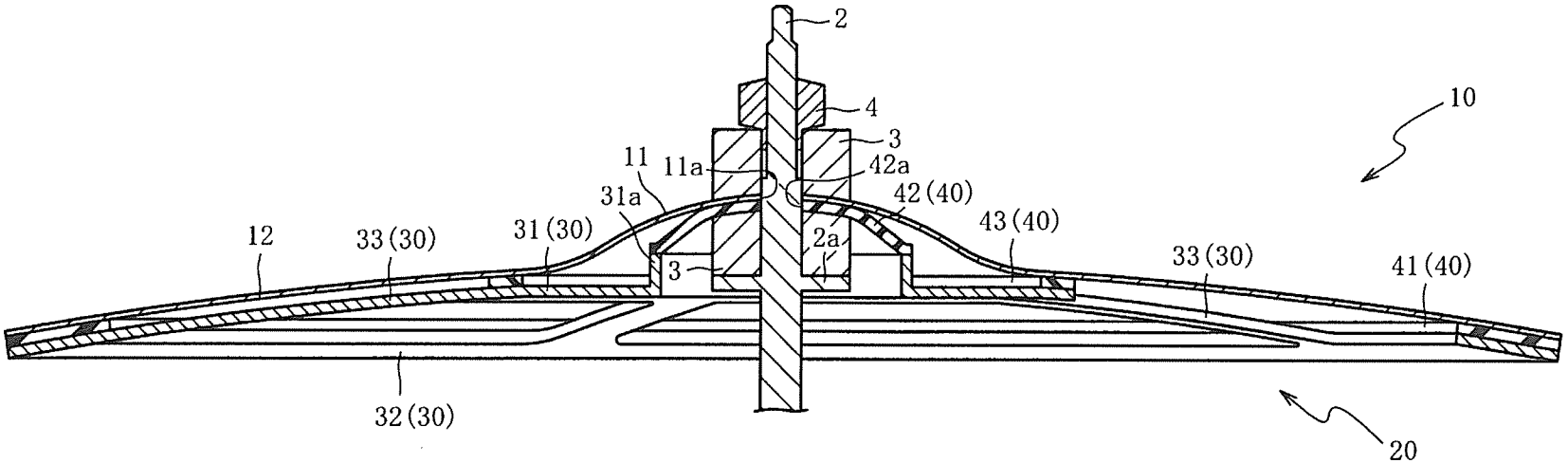
FIG. 3 is a sectional view of a cymbal stand in which a cymbal silencer and a cymbal are fixed.

Next, referring to FIG. 3, a detailed configuration of the cymbal stand is described in which the cymbal silencer 20 and the cymbal 10 are fixed. FIG. 3 is a sectional view of the cymbal stand and illustrates a cross section corresponding to FIG. 2B. In FIG. 3, only a main section of the cymbal stand is shown and the other part is omitted.

When the cymbal silencer 20 and the cymbal 10 are fixed to the rod 2, one of a pair of the felt washers 3 is first inserted with the rod 2, and then the one of the felt washers 3 is engaged with an upper surface of the metal washer 2*a*.

The cymbal silencer 20, with the one surface side of the frame 30 facing upward (an upper side in FIG. 3), is inserted with the rod 2 from an upper side of the one of the felt washers 3 already inserted with the rod 2. At this time, the rod 2 is inserted into the elastic member insertion hole 42*a* of the second elastic member 42. Then, the second elastic member 42 is engaged with the metal washer 2*a* by the one of the felt washers 3.

The cymbal 10 is stacked on the upper side of the cymbal silencer 20 with the rod 2 already inserted there-into for the rod 2 to insert into the cymbal insertion hole 11*a*. The rod 2 is inserted into the cymbal silencer 20 while the one surface side of the frame 30 faces toward the upper side. Therefore, the lower surface side of the cymbal 10 and the one surface side of the frame 30 are facing each other and a plurality of the elastic members 40 installed on the one surface side of the frame 30 are abutted to a lower surface of the cymbal 10.

The slope of the connecting part 33 in the radial direction is less steep than the slope of the bow portion 12 of the cymbal 10 in the radial direction. Moreover, the size in the axial direction of the frame insertion tube part 31*a* of the inner part 31 is set in order for the upper end of the frame insertion tube part 31*a* not being connected to the bell portion 11 of the cymbal 10 when the cymbal 10 is stacked on the upper surface side of the cymbal silencer 20. Therefore, when the cymbal 10 is stacked on the upper surface side of the cymbal silencer 20, the first elastic member 41 installed on the outer part 32 of the frame 30 is abutted to the cymbal 10 prior to the second elastic member 42 and the third elastic member 43 being installed on the inner part 31. At this time, a gap is formed between the second elastic member 42 and the third elastic member 43, and the lower surface of the cymbal 10.

The other one of a pair of the felt washers 3 is stacked on the upper side of the cymbal 10 with the rod 2 already inserted there-through for the rod 2 to insert into the hole of the felt washers 3. Then, the clamp nut 4 is tightened to the external thread threaded into the rod 2. By tightening the clamp nut 4, the pair of the felt washers 3, the cymbal silencer 20 and cymbal 10 are tightened and fixed between the clamp nut 4 and the metal washer 2*a*.

At this time, when the cymbal 10 is pressed down by the tightening of the clamp nut 4 to the rod 2, the outer part 32 of the frame 30 abutted to the bow portion 12 of the cymbal 10 is pressed down by the first elastic member 41.

The frame 30 comprises an elastic material. Moreover, the connecting part 33 comprises a plurality of members in a flat plate shape which is disposed radially. Hereby, a bending rigidity of the connecting part 33 in the axial direction of the outer part 32 (a vertical direction in FIG. 3) is small.

The outer part 32 of the frame 30 is pressed down while the second elastic member 42 is engaged with the metal washer 2*a*. Thus, the outer part 32 can move downward relative to the inner par 31 to cause the connecting part 33 an elastic deformation. Hereby, the first elastic member 41 and the third elastic member 43 installed on the one surface side of the frame 30 can be tightly attached to the lower surface side of the cymbal 10.

The first elastic member 41 comprises an elastic material with higher elasticity than the frame 30. In addition, the internal diameter of the first elastic member 41 is larger than the internal diameter of the bow portion 12 of the cymbal 10. Moreover, the external diameter of the first elastic member 41 is substantially equal to the external diameter of the bow portion 12. Accordingly, by tightening the clamp nut 4 to the rod 2, the first elastic member 41 can be pressed against the peripheral edge part of the bow portion 12 of the cymbal 10.

The cymbal 10 is fixed to the rod 2 in a state that the rod 2 is already inserted into the bell portion 11 located at the center. Therefore, the bow portion 12 located farther away from the rod 2 than the bell portion 11 has larger vibration when the cymbal 10 is struck. That is, the percussive sound generated from the bow portion 12 is louder than that from the bell portion 11.

On the contrary, since the cymbal silencer 20 can press the first elastic member 41 against the peripheral edge part of the bow portion 12, the vibration of the bow portion 12 can be effectively decreased by the first elastic member 41. Therefore, the percussive sound generated from the bow portion 12 can be significantly reduced.

In addition, since the internal diameter and the external diameter of the first elastic member 41 are substantially equal to the internal diameter and the external diameter of the outer part 32 of the frame 30, the outer part 32 can be prevented from abutting directly to the bow portion 12. Therefore, a crashed sound generated by the crashing between the outer part 32 and the bow portion 12 can be prevented.

The third elastic member 43 comprises an elastic material with a higher elasticity than that of the frame 30. Moreover, the third elastic member 43 is installed on the peripheral edge part of the inner part 31 (the external diameter is larger than the internal diameter of the bow portion 12 of the cymbal 10). Therefore, by tightening the clamp nut 4 to the rod 2 and making the connecting part 33 of the frame 30 to deform elastically to fit the shape of the cymbal 10, the third elastic member 43 can be pressed against the bow portion 12.

Hereby, a vibration of an inner side of the bow portion 12 or the bell portion 11 can be effectively decreased by the third elastic member 43. Therefore, the percussive sound generated from the inner side of the bow portion 12 or from the bell portion 11 can be significantly reduced.

In addition, the second elastic member 42 comprises an elastic material with a higher elasticity than that of the frame 30. Moreover, the peripheral edge part of the second elastic member 42 is installed on the upper end surface of the frame insertion tube part 31*a*. Therefore, when the frame 30 is pressed down via the cymbal 10 by screwing the clamp nut 4 to the rod 2, the peripheral edge part of the second elastic member 42 is pressed down. On the other hand, the center part of the second elastic member 42 is engaged with the metal washer 2*a* through one of the felt washers 3. Therefore, the clamp nut 4 is screwed to the rod 2, and the center part of the second elastic member 42 is pressed against the bell portion 11 of the cymbal 10.

Hereby, since a vibration of the bell portion 11 can be effectively decreased by the second elastic member 42, the vibration generated from the bell portion 11 can be significantly reduced.

In addition, the cymbal silencer 20 is fixed to the rod 2 in a state that the rod 2 is already inserted into the elastic member insertion hole 42*a* of the second elastic member 42 comprising an elastic material. Moreover, the external diameter of the frame insertion tube part 31*a* for installing the second elastic member 42 is larger than that of the felt washers 3 and the metal washer 2*a*. Therefore, the cymbal silencer 20 can be fixed in a manner that the cymbal silencer is swingable with respect to the rod 2.

Moreover, by fixing the cymbal silencer 20 to the rod 2, the frame 30 can be tightly attached to the cymbal 10 through the first elastic member 41, the second elastic member 42 and the third elastic member 43.

Therefore, the frame 30 can swing together with the cymbal when the cymbal 10 is struck very hard. Hereby, the blocking of a swing of the cymbal 10 due to the frame 30 can be suppressed. Accordingly, a force rebounded from the cymbal 10 can be prevented from becoming too strong; therefore, a decline of the percussing sense of the cymbal 10 can be prevented.

In addition, the first elastic member 41, the second elastic member 42 and the third elastic member 43 are pressed against the lower surface of the cymbal 10. Hereby, the first elastic member 41, the second elastic member 42 and the third elastic member 43 can be prevented from disposing on the upper surface side of the cymbal 10 where a performer strikes during performing. Therefore, the performer can directly strike the upper surface side of the cymbal 10 during performing while the percussive sound of the cymbal 10 is reduced. Accordingly, a decline of the percussing sense of the cymbal 10 can be prevented.

Moreover, the lower surface of the cymbal 10 is partially pressed by a plurality of the elastic members 40. Hereby, comparing with a case in which the entire lower surface of the cymbal 10 is pressed by a disc-shaped elastic member, a weight increase of the entire cymbal silencer 20 can be mitigated. As a result, a strong response of the cymbal 10, resulted of the weight increase of the cymbal silencer 20, can be prevented. That is, a decline of the percussing sense of the cymbal 10 can be suppressed.

In addition, the first elastic member 41, the second elastic member 42 and the third elastic member 43 can be pressed against the cymbal 10 by fixing the cymbal silencer 20 to the rod 2 together with the cymbal 10 while one surface side of the cymbal silencer 20 faces the lower surface side of the cymbal 10. Therefore, an attachment operation of the cymbal silencer 20 to the cymbal 10 can be simplified.

An elastic member used for the first elastic member 41, the second elastic member 42 and the third elastic member 43 includes, for example, a sponge, a rubber or urethane. In addition, an elastic member used for the frame 30 includes, for example, a resin material, a metallic material, wood or a rubber material.

When the frame 30 comprises a rubber material, the frame 30 can be integrally formed with the first elastic member 41, the second elastic member 42 and the third elastic member 43. Therefore, the manufacturing cost and the material cost can be reduced.

The present invention was described according to the embodiments, but the present invention is not limited to the above-mentioned embodiments. It should be apparent to those skilled in the art that various changes and modifications can be made within the spirit and scope of the invention.

For example, a sensor for detecting the vibration of the frame 30 when the cymbal 10 is struck may be installed. Accordingly, the cymbal 10 can be used as an electronic cymbal 10.

In the above-mentioned embodiments, a plurality of the elastic members 40 comprises the first elastic member 41, the second elastic member 42 and the third elastic member 43, but is not necessarily limited thereto. At least the first elastic member 41 only has to be installed on the outer part 32 of the frame 30. By decreasing the vibration of the bow portion 12 by the first elastic member 41 in which the vibration is larger than that with the bell portion 11 of the cymbal 10 fixed to the rod, the percussive sound of the cymbal 10 can be significantly reduced. In addition, by omitting the second elastic member 42 or the third elastic member 43 from a plurality of the elastic members 40, the material cost of the cymbal silencer 20 can be reduced.

In the above-mentioned embodiments, the frame 30 comprises a resin material and the second elastic member 42 comprises a rubbery member, but is not necessarily limited thereto. The second elastic member 42 may comprise a resin material formed integrally with the frame 30. Accordingly, the material cost of the cymbal silencer 20 can be suppressed.

In the above-mentioned embodiments, the first elastic member 41 and the third elastic member 43 are respectively made of a single member formed in a ring shape configured continuously along the circumference of the outer part 32 or the inner part 31, but the invention is not necessarily limited thereto. The first elastic member 41 and the third elastic member 43 may comprise a plurality of members. In this case, by intermittently arranging the first elastic member 41 or the third elastic member 43 along the circumference of the outer part 32 or the inner part 31, the material cost of the first elastic member 41 or the third elastic member 43 can be reduced. Moreover, the weight increase of the entire cymbal silencer 20 can be suppressed.

In the above-mentioned embodiments, the outer part 32 is formed in a ring shape, but is not necessarily limited thereto. The outer part 32 may be formed in another shape. For example, the outer part may be configured by continuously or intermittently arranging a plurality of strip-shaped members formed in an arc shape or in a straight-line shape along the circumference of the inner part 31. In addition, the outer part may include a circular ring part formed in a ring shape and an extension part extended radially from the circular ring part, and the first elastic member 41 may be installed on the extension part.

In the above-mentioned embodiments, the surfaces of the first elastic member 41 and the third elastic member 43 abutted to the cymbal 10 are smooth surfaces, but the invention is not necessarily limited thereto. Projections may be formed on the surfaces of the first elastic member 41 and the third elastic member 43 abutted to the cymbal 10. Hereby, the amount of the elastic material being used for the first elastic member 41 and the third elastic member 43 can be suppressed while ensuring the thickness of the first elastic member 41 and the third elastic member 43 on the part abutted to the cymbal 10. As a result, the material cost of the first elastic member 41 and the third elastic member 43 can be reduced. Moreover, the weight increase of the entire cymbal silencer 20 can be suppressed. In addition, the height of a protrusion part formed on the surface abutted to the cymbal 10 of the first elastic member 41 or the third elastic member 43 can be set properly. By setting the height of the protrusion part, even if the first elastic member 41 or the third elastic member 43 comprises an elastic material with lower elasticity, the part of the first elastic member 41 or the third elastic member 43 abutted to the cymbal 10 can have a higher elasticity.

In the above-mentioned embodiments, the connecting part 33 of the frame 30 comprises a plurality of members disposed radially, but the invention is not necessarily limited thereto. Viewing from an axial direction of the outer part 32, by extending the connecting part toward a direction away from the frame insertion tube part 31*a* and partially connecting the inner part 31 and the outer part 32 by the connecting part, the outer part 32 may be configured to be movable in the axial direction relative to the inner part 31. By changing the shape of the connecting part 33 properly, the rigidity of the connecting part 33 can be adjusted. In addition, the connecting part 33 may be made of a single member formed in a ring shape. Accordingly, the shape of the frame 30 can be simplified and the manufacturing cost of the frame 30 can be suppressed.

In addition, in the above-mentioned embodiments, a plurality of the members configures the connecting part 33. Each of the plurality of the members is formed in a flat plate shape of which the cross section is a substantially rectangle shape with the tangential direction of the outer part as the longitudinal direction, but the invention is not necessarily limited thereto. A plurality of the members configuring the connecting part 33 has only to be formed in a shape can be deformed elastically toward the axial direction of the outer part 32 (for example, in a substantially elliptical shape in which the cross section vertical to the outer part 32 uses the tangential direction as the longitudinal diameter).

In the above-mentioned embodiments, the external diameter of the outer part 32 of the frame 30 and the external diameter of the first elastic member 41 are set to be substantially equal to the external diameter of the bow portion 12 of the cymbal 10, but the invention is not necessarily limited thereto. The external diameter of the outer part 32 of the frame 30 and the external diameter of the first elastic member 41 may be set to be larger or smaller than the external diameter of the bow portion 12 of the cymbal 10.

In this case, by setting the internal diameter of the outer part 32 of the frame 30 and the internal diameter of the first elastic member 41 to be smaller than at least the external diameter of the bow portion 12 of the cymbal 10, the first elastic member 41 can abut to the bow portion 12. In addition, the internal diameter of the outer part 32 of the frame 30 and the internal diameter of the first elastic member 41 can be set to be larger than the internal diameter of the bow portion 12 of the cymbal 10, and the external diameter of the outer part 32 and the external diameter of the first elastic member 41 can be set to be equal to or smaller than the external diameter of the bow portion 12. Accordingly, comparing with a case in which the first elastic member 41 is pressed against the entire bow portion 12 of the cymbal 10, the material cost of the cymbal silencer 20 can be reduced. Moreover, the weight increase of the cymbal silencer 20 can be suppressed.

In addition, in the above-mentioned embodiments, the internal diameter and the external diameter of the first elastic member 41 is set to be substantially equal to the internal diameter and the external diameter of the outer part 32 of the frame 30, but the invention is not necessarily limited thereto. The internal diameter and the external diameter of the first elastic member 41 may be set to be larger or smaller than the internal diameter and the external diameter of the outer part 32 of the frame 30.

In this case, the internal diameter of the first elastic member 41 can be set to be equal to or larger than the internal diameter of the outer part 32, and the external diameter of the first elastic member 41 can be set to be equal to or smaller than the external diameter of the outer part 32. Hereby, when the cymbal silencer 20 and the cymbal 10 are fixed to the rod 2, the entire first elastic member 41 can be held between the cymbal 10 and the outer part 32. Therefore, the entire first elastic member 41 can be pressed against the bow portion 12 of the cymbal 10 without waste.

In the above-mentioned embodiments, the external diameter of the third elastic member 43 is set to be substantially equal to the external diameter of the inner part 31, and the third elastic member 43 is installed on the peripheral edge part of the one surface side of the inner part 31; the invention, however, is not necessarily limited thereto. The third elastic member 43 can be installed on the one surface side of the frame 30 at a position that is abuttable to the bow portion 12 of the cymbal 10 or the connecting part of the bell portion 11 and the bow portion 12. That is, the external diameter of the third elastic member 43 may be set to be smaller than the external diameter of the inner part 31 of the frame 30, and the third elastic member 43 may be installed on the connecting part 33 of the frame 30.

In the above-mentioned embodiments, the frame insertion tube part 31*a* is formed on the inner part 31 of the frame 30, but the invention is not necessarily limited thereto. The frame insertion tube part 31*a* may be omitted. In this case, at least a hole into which the rod 2 can be inserted may be formed at the center part of the inner part 31.

In the above-mentioned embodiments, the slope in the radial direction of the connecting part 33 of the frame 30 is less steep than the slope of the bow portion 12 of the cymbal 10, but the invention is not necessarily limited thereto. The slope in the radial direction of the connecting part 33 and the slope in the radial direction of the bow portion 12 may be set to have the same slope angle. Hereby, the third elastic member 43 can be more tightly attached to the bow portion 12.

In the above-mentioned embodiments, during inserting of the rod 2 into the cymbal silencer 20 and the cymbal 10, the cymbal 10 is stacked on the cymbal silencer 20 from the upper side of the cymbal silencer 20 in a manner that the rod 2 is inserted into the cymbal insertion hole 11*a* after the rod 2 is already inserted into the cymbal silencer 20; but the invention is not necessarily limited thereto. The rod 2 can be inserted into the cymbal silencer 20 and the cymbal 10 in a state that the cymbal silencer 20 is already fixed to the cymbal 10.

For example, a pair of holding members are used in which a hole through which the rod 2 is insertable is formed. At least one of the pair of holding members has an insertion part which is insertable into the elastic member insertion hole 42*a* of the second elastic member 42 and the cymbal insertion hole 11*a* of the cymbal 10. Then, the cymbal silencer 20 and the cymbal 10 are held and fixed by a pair of the holding members while the insertion part of the holding members is inserted into the elastic member insertion hole 42*a* of the second elastic member 42 and the cymbal insertion hole 11*a* of the cymbal 10.

In this case, the degree of tightly attaching the cymbal silencer 20 to the cymbal 10 by a pair of the holding members and the degree of screwing the cymbal 10 to the rod 2 by the clamp nut 4 can be individually adjusted. Hereby, a swinging condition of the cymbal 10 with respect to the rod 2 can be freely adjusted, while the cymbal silencer 20 is securely fixed to the cymbal 10.

What is claimed is:

1. A cymbal silencer, reducing a percussive sound of a cymbal by abutting against the cymbal, wherein the cymbal includes a cup-shaped bell portion sloping downward toward a peripheral of the bell portion in a radial direction and a ring-shaped bow portion extended in a flange shape from an outer edge of the bell portion and sloping downward toward a peripheral of the bow portion in the radial direction at a sloping angle less steep than that of the bell portion, the cymbal silencer, comprising:

a frame, comprising an inner part having an insertion hole into which a bar-shaped rod for fixing the cymbal is inserted, a connecting part of which one side is connected to the inner part and extended toward a direction away from the insertion hole viewed from a top view, and an outer part connected to an other side of the connecting part and disposed further away from the insertion hole than the one side of the connecting part, and the outer part corresponds to the bow portion of the cymbal;

a first elastic member, installed on one surface side of the outer part of the frame and comprising a first elastic material, wherein the first elastic member is pressed against the bow portion of the cymbal by securing the frame and the cymbal, while one surface side of the frame faces a lower surface of the cymbal, and the frame and the cymbal together are inserted with the rod; and a second elastic member, installed on the one surface side of the inner part of the frame and comprising a second elastic material, wherein the second elastic member is pressed against the bell portion of the cymbal by securing the frame and the cymbal, while the one surface side of the frame faces the lower surface of the cymbal, and the frame and the cymbal together are inserted with the rod.

2. The cymbal silencer as claimed in claim 1, comprising:

a third elastic member, installed on the one surface side of the frame closer to the insertion hole than the first elastic member but further away from the insertion hole than the second elastic member, and comprising a third elastic material;

wherein the third elastic member is pressed against the bow portion of the cymbal by fixing the frame and the cymbal, while the one surface side of the frame faces the lower surface of the cymbal, and the frame and the cymbal are inserted together with the rod.

3. The cymbal silencer as claimed in claim 2, wherein an external diameter of the inner part of the frame is larger than an internal diameter of the bow portion of the cymbal.

4. The cymbal silencer as claimed in claim 2, wherein surfaces of the first elastic member and the third elastic member abutted to the cymbal are smooth surfaces.

5. A cymbal silencer, reducing a percussive sound of a cymbal by abutting against the cymbal, wherein the cymbal includes a cup-shaped bell portion sloping downward toward a peripheral of the bell portion in a radial direction and a ring-shaped bow portion extended in a flange shape from an outer edge of the bell portion and sloping downward toward a peripheral of the bow portion in the radial direction at a sloping angle less steep than that of the bell portion, the cymbal silencer comprising:

a frame, comprising an inner part having an insertion hole into which a bar-shaped rod for fixing the cymbal is inserted, a connecting part of which one side is connected to the inner part and extended toward a direction away from the insertion hole viewed from a top view, an outer part connected to an other side of the connecting part and disposed further away from the insertion hole than the one side of the connecting part, and the outer part corresponds to the bow portion of the cymbal; and a first elastic member, installed on one surface side of the outer part of the frame and comprising a first elastic material, wherein the first elastic member is pressed against the bow portion of the cymbal by securing the frame and the cymbal, while one surface side of the frame faces a lower surface of the cymbal, and the frame and the cymbal together are inserted with the rod, wherein the frame comprises a fourth elastic material, and the inner part and the outer part are partially connected by the connecting part, and the outer part is configured to be movable in a vertical direction relative to the inner part.

6. The cymbal silencer as claimed in claim 5, wherein the connecting part of the frame is configured by radially disposing a plurality of members configured in a flat plate shape.

7. The cymbal silencer as claimed in claim 5, comprising a sensor, installed on the frame and detecting a vibration of the frame when the cymbal is struck.

8. The cymbal silencer as claimed in claim 5, wherein the inner part of the frame comprises a frame insertion tube part into which the rod is inserted, wherein the frame insertion tube part is formed in cylindrical shape at a center portion of the inner part, and the frame insertion tube part is protruded from the one side surface of the frame.

9. The cymbal silencer as claimed in claim 8, wherein an external diameter of the frame insertion tube part is smaller than an internal diameter of the bow portion of the cymbal.

10. The cymbal silencer as claimed in claim 9, wherein an upper end of the frame insertion tube part does not contact with the bell portion of the cymbal.

11. The cymbal silencer as claimed in claim 5, wherein the outer part of the frame is formed in a ring shape.

12. The cymbal silencer as claimed in claim 5, wherein a plurality of members are arranged along a circumference of the inner part of the frame to construct the outer part of the frame.

13. The cymbal silencer as claimed in claim 5, wherein the outer part of the frame comprises a circular ring part formed in a ring shape and an extension part extended radially from the circular ring part, wherein the first elastic member is installed on the extension part.

14. The cymbal silencer as claimed in claim 5, wherein a slope in the radial direction of the connecting part of the frame is less steep than a slope in the radial direction of the bow portion of the cymbal.

15. The cymbal silencer as claimed in claim 5, wherein the cymbal and the cymbal silencer are together fixed to the bar-shaped rod.

16. The cymbal silencer as claimed in claim 5, wherein the inner part of the frame is fixed in a manner that the inner part is swingable with respect to the rod.

* * * * *